United States Patent [19]

Ball et al.

[11] Patent Number: 4,565,353

[45] Date of Patent: Jan. 21, 1986

[54] APPARATUS FOR SUPPRESSING FUME FROM A METAL POURING OPERATION

[75] Inventors: David M. Ball, Peters Township, Washington County, Pa.; Alton E. Sumsion, American Fork; Zane S. Taylor, Orem, both of Utah

[73] Assignee: United States Steel Corporation, Pittsburgh, Pa.

[21] Appl. No.: 645,366

[22] Filed: Aug. 29, 1984

Related U.S. Application Data

[60] Division of Ser. No. 533,897, Sep. 21, 1983, Pat. No. 4,486,230, which is a continuation of Ser. No. 286,395, Jul. 23, 1981, abandoned.

[51] Int. Cl.[4] ..... C21C 5/40

[52] U.S. Cl. ..... 266/147; 239/424.5; 261/116; 261/DIG. 76

[58] Field of Search ..... 261/DIG. 76, 115, 116; 239/433, 567, 424.5; 266/147, 46, 259, 146

[56] References Cited

U.S. PATENT DOCUMENTS

| | | | |
|---|---|---|---|
| 3,852,409 | 12/1974 | Martin et al. | 55/59 |
| 4,250,951 | 2/1981 | Mezger et al. | 239/433 |
| 4,386,763 | 6/1983 | Meinert et al. | 266/144 |

FOREIGN PATENT DOCUMENTS

| | | | |
|---|---|---|---|
| 6020321 | 6/1976 | Japan | 266/147 |

*Primary Examiner*—Melvyn J. Andrews
*Attorney, Agent, or Firm*—John F. Carney

[57] ABSTRACT

Method and apparatus for the suppression of fume from a body of molten metal is described. The method involves the blanketing of the molten metal bath with a mixture of pressurized inert gas and finely divided or atomized particles of water. The inert gas may be argon, nitrogen or steam. Apparatus particularly adapted for performing the disclosed method is also described.

6 Claims, 11 Drawing Figures

FIG. 3
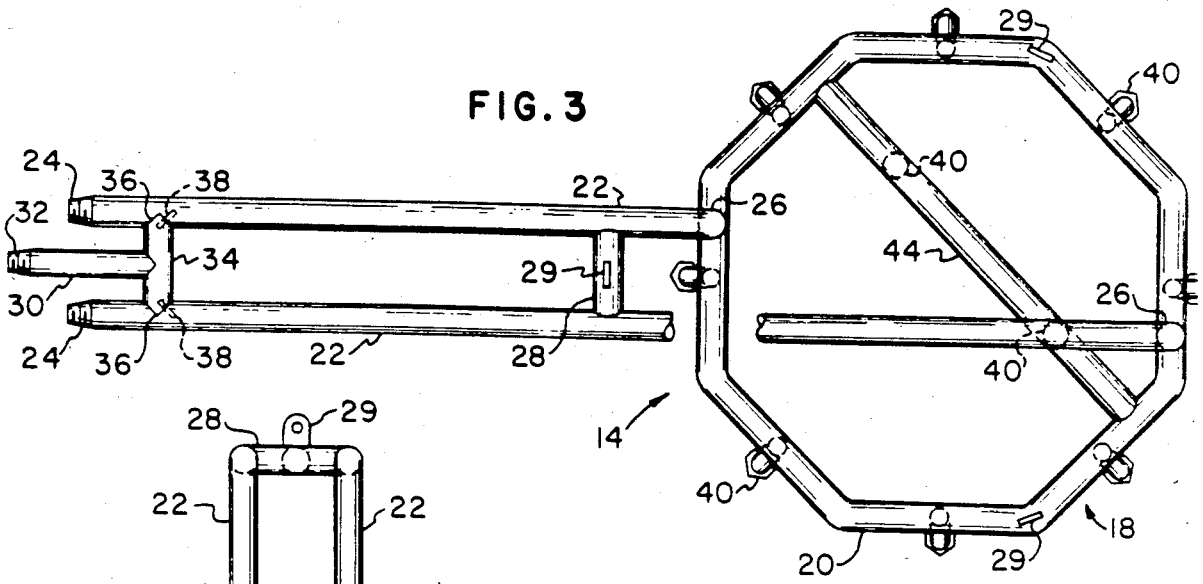
FIG. 4
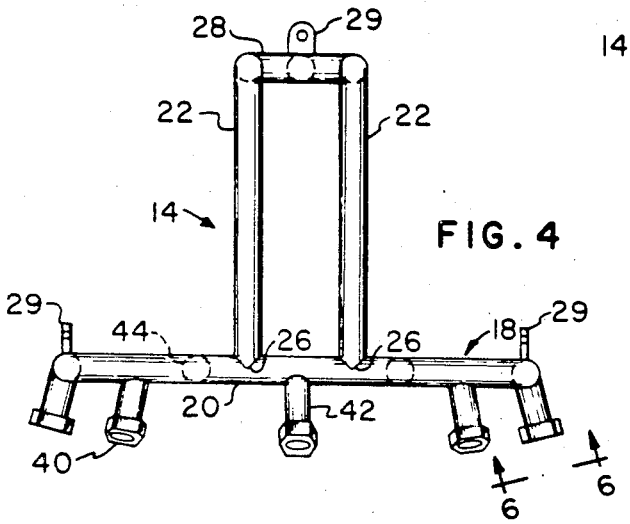
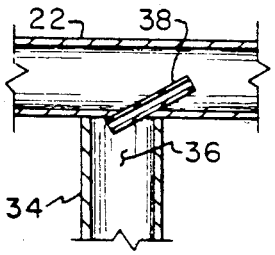
FIG. 5
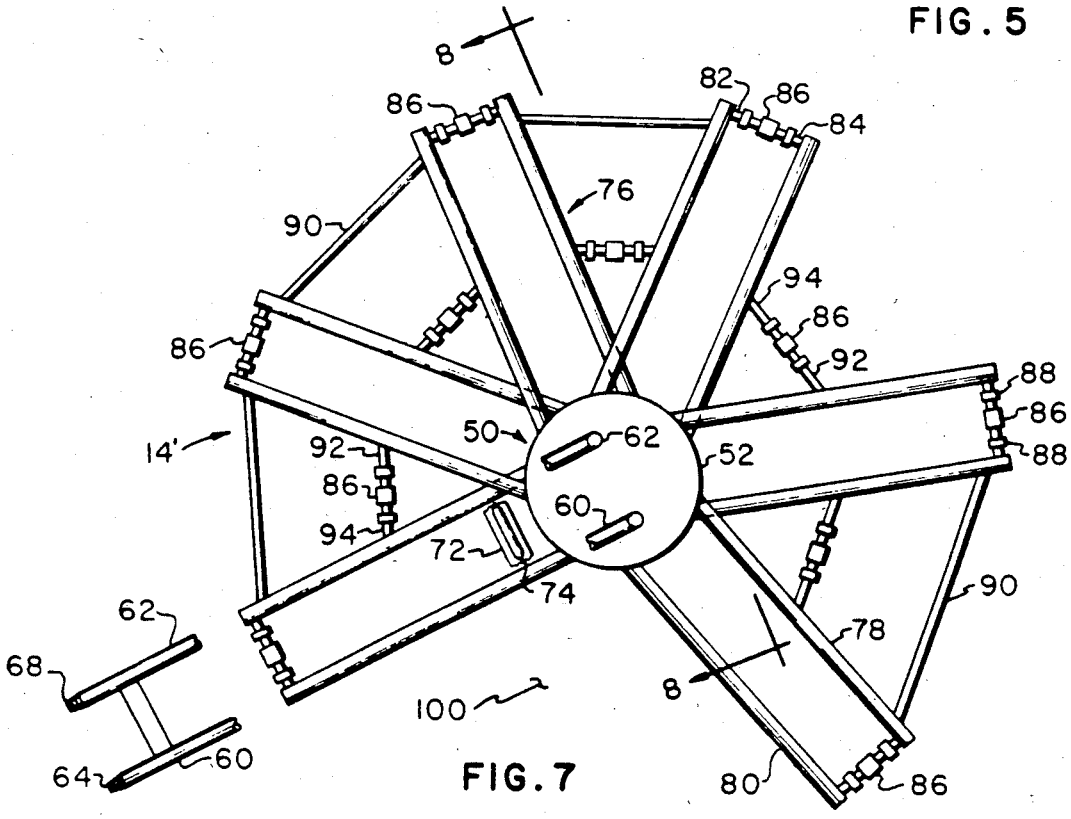
FIG. 7

APPARATUS FOR SUPPRESSING FUME FROM A METAL POURING OPERATION

This is a divisional of application Ser. No. 533,897, filed Sept. 21, 1983, now U.S. Pat. No. 4,486,230, which is a file wrapper continuation of application Ser. No. 286,395, filed July 23, 1981, now abandoned.

BACKGROUND OF THE INVENTION

The present invention pertains to the suppression of undesirable fugitive emissions or fume that is prevalent in the pouring of molten metal, particularly that of iron or steel.

When molten metals are poured from one container to another in various metal production processes the pouring is accompanied by the emission from the receiving container of large amounts of fume. One typical example is the transfer of refined steel into a receiving ladle upon tapping of the converter or steelmaking furnace.

The generation of such fugitive emissions constitutes a serious atmospheric pollution problem associated with many metallurgical processes, the abatement of which represents a significant part of the cost of Performing these processes. Much effort and expense has been expended in the development of emission control systems that are effective to maintain the volume of fugitive emissions within acceptable limits. These efforts are exemplified by the arrangement of various forms of air or gas curtains and fume exhaust equipment to isolate the affected region of the plant and to conduct the undesirable effluent to treating apparatus prior to its discharge into the atmosphere. Such systems are exemplified by U.S. Pat. No. 3,396,954, granted Aug. 13, 1968 to Krogsrud; U.S. Pat. No. 3,834,293, granted Sept. 10, 1974 to Danieli; and U.S. Pat. No. 3,994,210, granted Nov. 24, 1975 to Davis. These systems all rely on the capture and disposal of the fugitive fume and, while being effective to a limited degree in solving the concerned problem, entail significant capital expenditure to install and are costly to operate.

In Japanese Pat. No. 53-6602, granted Mar. 9, 1978 to Nippon Steel Corporation, on the other hand, is described an emission control system by means of which fugitive fume is controlled by spraying an inert gas, typically steam or nitrogen, into the molten metal receiver. Spraying is achieved by an ejector ring that is suspended into the vessel to position it closely above the level of the molten bath. The ring is suspended by a hoist that enables the ring to be raised as the bath level rises thereby to maintain a relatively constant spacing between the ejector ring and the bath surface.

Although this gas ejector of the Japanese patent is an improvement over prior art devices of the aforementioned type in that it is effective to suppress to a limited extent the formation of fume, its use is not totally dispositive of the problem. Firstly, the ejection of steam or nitrogen onto a molten bath has been found to be not, by itself, capable of suppressing the generation of fume to an acceptable level. Tests conducted by applicants indicate that fume suppression in this manner is only about seventy percent effective. Secondly, the need to maintain the ejector ring closely adjacent the level of the bath subjects the equipment to the possibility of damage due to the extremely high temperature environment in which it is used and to the danger of contacting the bath itself or being impinged upon by splashing metal which plugs the gas ejection ports thereby to rapidly render the ring inoperative.

It is to the solution of the above problem and to the development of a more effective manner of suppressing the emission of fugitive fume from molten metal operations that the present invention is directed.

SUMMARY OF THE INVENTION

There is provided in accordance with one aspect of the present invention a method of suppressing the emission of fume from a vessel containing a molten metal bath exposed to the atmosphere comprising the step of ejecting a mixture of atomized water and inert gas into said vessel to blanket the surface of the bath therein to a degree sufficient to prevent atmospheric air from combining with the metal of the bath.

According to another aspect of the invention, there is provided apparatus for performing the above described method including a frame means for supporting said frame adjacent the mouth of said vessel; and fluid ejector means affixed to said frame for ejecting a mixture of inert gas and atomized water into said vessel to blanket the surface of the body of molten metal therein.

It is a particular object of the present invention to provide a novel method of and apparatus for suppressing fugitive fume emissions from vessels containing a body of molten metal.

It is another object of the invention to provide an effective method of and apparatus for preventing the mission of fume during the transfer of molten metal from a source to a receiving vessel during which transfer the emission of fume is normally most prevalent.

A further object of the invention is to provide a method of and apparatus for injecting blanketing fluid over the surface of the molten bath within a receiver in a manner as will effectively starve the bath of atmospheric air in order to retard or prevent the generation of fume.

Yet another object of the invention is to provide a method and apparatus for effectively delivering a molten bath blanketing medium from a source without the interior of the receiving vessel.

Still another object of the invention is to provide a method of and apparatus for delivering to a molten bath a blanketing medium in a manner as will enable the mechanical capture of fume that escapes the bath blanket thereby to augment the prevention of fugitive emissions from the receiver vessel.

For a better understanding of the invention, its operating advantages and the specific objectives obtained by its use, reference should be made to the accompanying drawings and description which relate to a preferred embodiment thereof.

BRIEF DESCRIPTION OF THE DRAWINGS

FIG. 3 is a plan view of the device of FIG. 2;

FIG. 4 is a front elevational view of the device of FIG. 2;

FIG. 5 is a sectional view taken at the nexus between the water line and one gas line in the device of FIG. 2;

FIG. 7 is a plan view of another form of fume suppression apparatus according to the present invention;

DESCRIPTION OF A PREFERRED EMBODIMENT OF THE INVENTION

Figure 1:
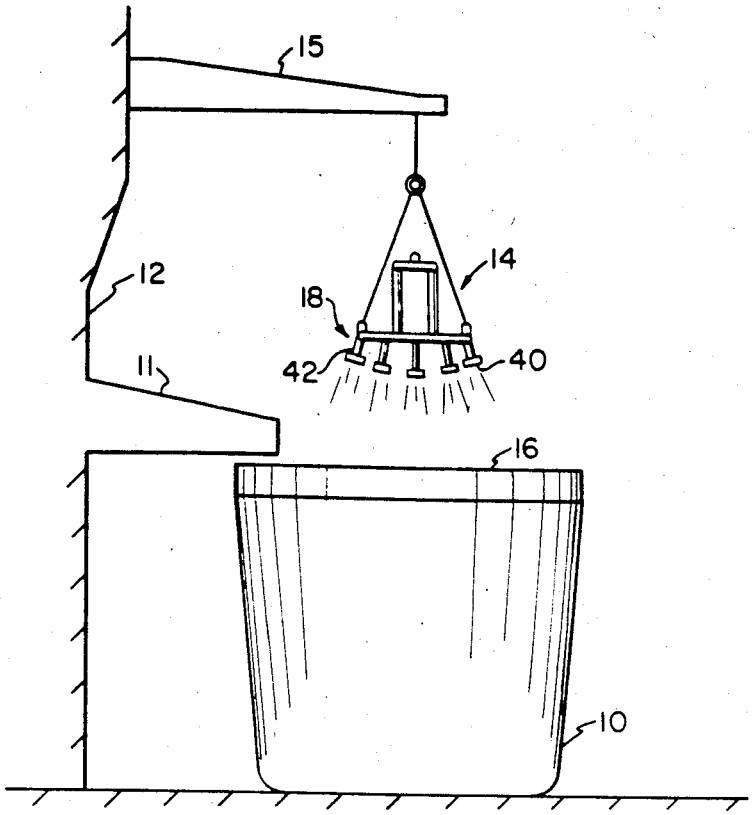
FIG. 1 is an arrangement drawing illustrating one form of fume suppression device according to the present invention operatively disposed with respect to a molten metal receiving vessel.

In order to indicate a typical application of the present invention in FIG. 1 of the drawing there is shown a vessel 10, commonly referred to as a tapping ladle, for receiving molten metal from the discharge spout 11 of an open hearth furnace, indicated schematically at 12. It should be understood, however, that the invention is equally applicable to other metal-pouring applications.

As is well known, the pouring of metal into tapping ladles in steel- and other metal-pouring operations is normally accompanied by the generation of excessive amounts of fume that essentially comprise finely divided iron oxide and dust particles mixed with gaseous contaminants, which, if discharged to the atmosphere, present a serious pollution problem.

Figure 2:
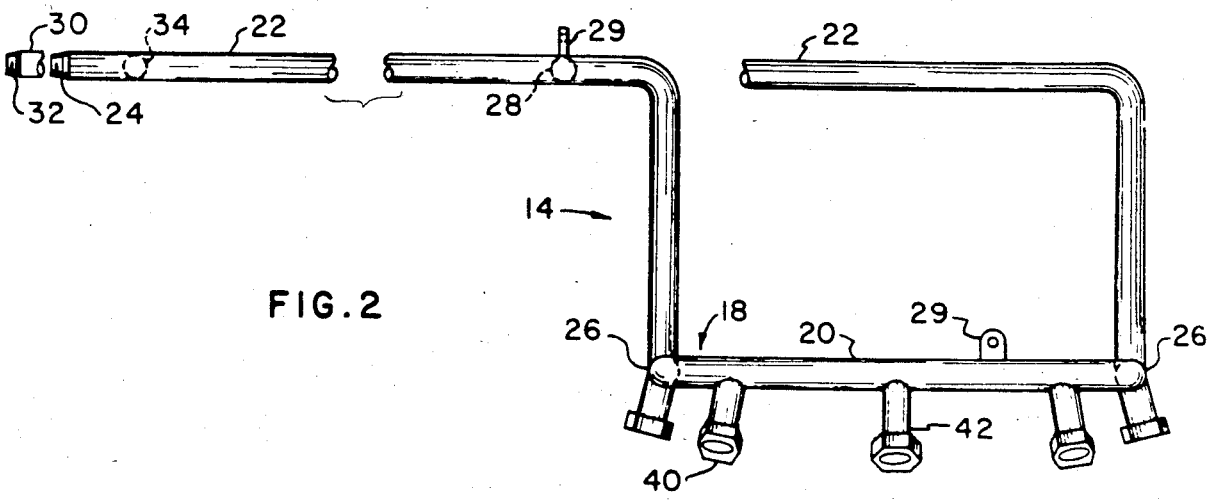
FIG. 2 is a side elevational view in enlarged scale of the fume suppression device illustrated in FIG. 1.
Figure 6:
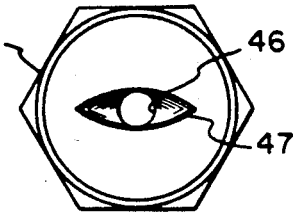
FIG. 6 is an enlarged view taken along line 6—6 of FIG. 4.

In order to abate this problem, in the arrangement of FIG. 1 there is provided fume suppression apparatus 14 suspended from an overhead support 15 in overlying relation to the mouth 16 of the vessel 10. The apparatus 14, as shown in FIG. 2, includes a frame structure 18 comprising welded tubular members defining an annular manifold 20 and a pair of gas inlet lines 22, here shown as steam lines, the inlet ends 24 of each of which connect with a source of steam at an elevated pressure and the outlet ends 26 of which communicate with the manifold at diametrically spaced points thereabout. The lines 22 may be laterally stiffened by a brace 28 that also serves to mount one of a plurality of mutually spaced lifting bales 29 for suspending the apparatus. The other bales 29 may be as shown weldedly attached to the manifold 20. Pressurized water is delivered to each of the lines 22 from a supply line 30 that connects at its inlet end 32 to a source. The outlet end of the line 30 is formed as a T-member 34, the discharge ends 36 of which communicate with each of the steam lines 22.

Communication between the ends 36 of the T-member 34 and the steam lines 22 is effected as shown in FIG. 5 by short lengths of tubing 38 that penetrate the wall of the respective steam lines at an angle acute in the direction of steam flow. In this way pressurized water emerging from the tubes 38 is atomized by the steam into finely divided particles and the mixture delivered to the manifold 20 for ejection from a plurality of ejector nozzles 40 whose discharge openings are directed into the interior of the vessel 10.

Nozzles 40 are disposed in circumferentially spaced array about the manifold 20 and connect thereto by means of depending extensions 42. An additional pair of nozzles 40 may be provided at spaced locations along a line extending diametrically across the mouth of the vessel 10 defined by a crossover tube 44.

It has been found that flat fan nozzles similar to those identified as Sprayco Model No. 25101526 are functionally effective for use as the nozzles 40. These apparatus have a discharge opening 46 enclosed within an oval recess 47 that serves as a baffle to produce a divergent spray pattern in the ejected mixture that effectively blankets the full surface of the metal bath within the vessel 10 that may reside anywhere from 14 to 0 feet below the vessel mouth.

In a typical installation for suppressing fume from an open hearth tapping ladle of 350-ton capacity whose mouth is approximately 13 feet in diameter apparatus 14 of the described type having an effective manifold diameter of about three feet is suspended about 2 feet above the ladle mouth in substantial concentric relation with the vertical axis thereof. In this position the apparatus 14 is above the furnace trough 11 so as to be removed from danger of contact with the molten metal pour stream from the trough to the ladle 10. At, or just prior to, the commencement of the furnace tap steam at a temperature of between 470° F. to 500° F. and a pressure of between 160 psig and 180 psig is admitted to the lines 22 at a rate of about. 10,000 to 12,000 pounds per hour. Simultaneously therewith water at about 150 psig at the rate of 40 to 60 gallons per minute is supplied to the water line 30 from whence it is ejected via tubes 38 into the respective steam lines to be atomized and directed from the discharge openings 46 of nozzles 40 in a divergent pattern to blanket the surface of the molten metal bath.

It has been found that by blanketing the bath by means of an ejected mixture of steam and atomized water particles fume suppression between 99% and 100% effectiveness can be obtained. Obviously the physical characteristics of the steam and water components of the mixture may be altered depending on the size and capacity of the vessel containing the bath to be blanketed. Also, it is contemplated that other non-oxidizing gases such as nitrogen or argon may be employed as the atomizing medium.

Figure 9:
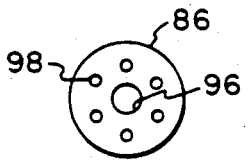
FIG. 9 is a view taken along line 9—9 of FIG. 7.
Figure 8:
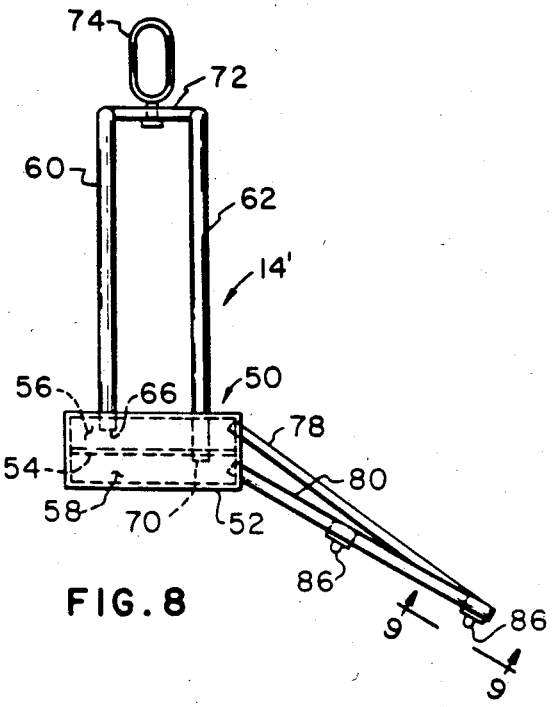
FIG. 8 is an elevational view, partly in section of the device of FIG. 7.

FIGS. 7 through 9 of the drawing illustrate another operative, though somewhat less desirable, embodiment of the invention. In this embodiment fume suppression apparatus, indicated generally as 14', comprises a frame structure 50 including a centrally disposed closed manifold 52 whose interior is divided by a horizontal partition 54 into vertically spaced water and steam compartments, 56 and 58 respectively. A pair of parallelly extending tubular supply lines comprising water supply line 60 and steam supply line 62 serve to deliver the fluid mixture components to the respective compartments 56 and 58, line 60 having its inlet end 64 connecting with a source of pressurized water and its discharge end 66 communicating with the manifold water compartment 56 while line 62 has its inlet end 68 similarly connected to a source of pressurized steam and its discharge end 70 in communication with the manifold steam compartment 58. Lines 60 and 62 are appropriately braced by support bars 72, one or more of which may mount a suspension bale 74 for suspending the apparatus above the receiving vessel 10.

Emanating from the manifold 52 are radially extending legs 76, each comprising a water tube 78 and a steam tube 80, the inlet ends of each communicate with the appropriate compartment 56 or 58 of the manifold and the free ends of which are closed. Extending between and connecting the tubes 78 and 80 adjacent their free ends are feeder lines 82 and 84 that connect with opposite sides of an ejector nozzle 86. Unions 88 are provided in the feeder lines to facilitate replacement of the nozzles should such become necessary. Chordal braces 90 are advantageously welded between adjacent legs in order to stiffen the structure while an additional set of feeder lines 92 and 94 may be provided to connect another course of nozzles 86 on alternate spacing with the first course and radially inwardly therefrom.

Nozzles 86 in the described apparatus are of the type produced by Spraying Systems Co. under model no. IJ-SUE-175B which, as shown in FIG. 9, have a centrally disposed water discharge opening 96 surrounded by a plurality of smaller diameter steam discharge openings 98. Appropriate passages within the body of nozzles 86 connect the respective openings with the steam and water lines 82 and 84 respectively.

In practice the operation of this embodiment of the invention is substantially identical to that described above, the difference being that water atomization occurs externally of the nozzles 86 and, accordingly, apparatus 14' having an effective diameter comparable to that of the ladle mouth, is utilized for effective blanketing of the molten metal bath.

In the described arrangement extended spacing as at 100 may be provided between a pair of adjacent legs 76 to accommodate access of the furnace trough when the apparatus is positioned in close proximity to the ladle mouth.

Figure 11:
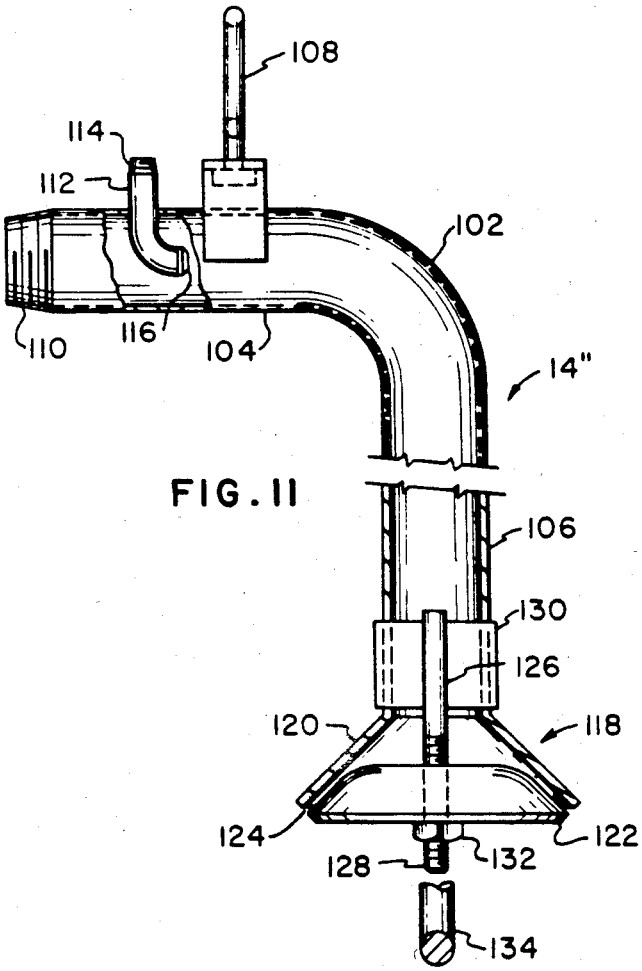
FIG. 11 is a side view partly in section of the apparatus of FIG. 10.
Figure 10:
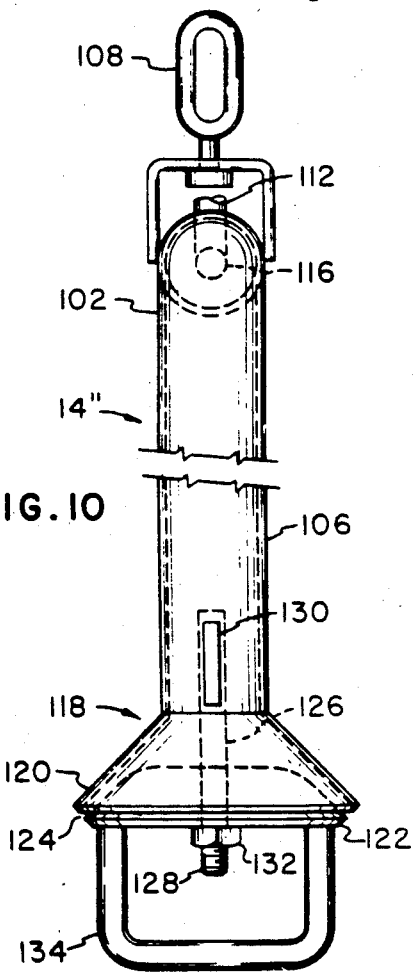
FIG. 10 is a front elevational view of yet another form of fume suppression apparatus according to the invention.

FIGS. 10 and 11 illustrate yet another alternative form of apparatus adapted for the practice of the present invention. This apparatus, indicated generally as 14'', comprises a gas line 102 of somewhat enlarged diameter angularly offset to define a generally horizontal leg 104 and a vertical leg 106. A lifting bale 108 connects with the horizontal leg for suspending the apparatus above a receiver vessel (not shown). At its free or inlet end 110 the leg 104 is adapted for connection to a pressurized gas source, contemplated primarily to be steam. A water line 112 adapted at 114 for connection to a source of pressurized water penetrates the leg 104 immediately downstream of the inlet end 110 and is angularly offset to dispose its discharge end in the form of a spray nozzle 116 substantially on the axis of the leg. Water issuing from the nozzle 116 is atomized by the gas admitted to the line 102 in a manner similar to that described above and the mixture delivered for discharge from the downwardly directed outlet 118.

Outlet 118 includes a conically formed divergent head 120 adapted to receive a baffle cone 122. The baffle cone 122 is mounted within the head 120 with its peripheral surface spaced from the facing surface of the head as at 124 to provide an annular discharge opening capable of producing a divergent spray in a hollow conical pattern. The cone 122 is adjustably mounted within the head by means of a support stud 126 having a threaded lower end 128 and an upper end weldedly attached to a diametric mounting plate 130 fixed to the leg 106. Attachment of the cone to the stud is effected by an adjustable nut 132. The cone 122 may be provided with a handle 134 to facilitate its manipulation during setup.

The operation of this alternative form of the inventive apparatus is substantially the same as those described hereinabove except that, due to the production of a hollow conical spray the apparatus 14'' is positioned to direct the spray pattern such that it wipes the interior wall of the ladle. In this way a blanketing envelope is produced above the molten metal bath capable of preventing the entry of oxygen into the affected region and thereby to prevent the generation of fume.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. In combination with an open-ended vessel for receiving a stream of molten metal therein, apparatus for suppressing the generation of metal oxide fume within the interior of said vessel, said apparatus comprising:

(a) nozzle means operative to eject a mixture of inert gas and atomized water having its discharge disposed to direct said mixture into the interior of said vessel for blanketing the surface of the body of molten metal therein;

(b) first fluid conducting means connecting said nozzle means and extending between said nozzle means and a source of inert gas;

(c) second fluid conducting means extending between a source of water and communicating with the interior of said first fluid conducting means upstream from the connection of said nozzle means;

(d) said second fluid conducting means having its discharge end disposed within said first fluid conducting means with its axis inclined in the direction of the axis of said first fluid conducting means, whereby water discharged into said first fluid conducting means is atomized and intimately mixed with said inert gas prior to discharge from said nozzle means; and (e) means for suspending said apparatus in operative relation to said vessel open end.

2. The combination according to claim 1 in which said nozzle means includes a plurality of annularly spaced ejector nozzles, the discharge thereof being directed as divergent streams into the interior of said vessel and said first fluid conducting means includes a generally annular manifold portion and means connecting said ejector nozzle in fluid communication with said manifold portion.

3. The combination according to claim 2 in which said first fluid conducting means includes a pair of substantially parallel fluid conductors, the ends of each of which attaching to and communicating with said manifold portion at substantially diametrically spaced locations thereon; said second fluid conducting means includes a fluid conductor, one end of which is bifurcated and connecting with each of said fluid conductors of said first fluid conducting means, said second fluid conducting means communicating therewith via reduced diameter tubing inclined axially of the conductors of said first fluid conducting means.

4. The combination according to claim 1 in which said first fluid conducting means comprises a fluid conductor terminating at its discharge end in nozzle means defined by a conically divergent wall portion of said fluid conductor and a conical body disposed within said wall portion with its periphery spaced therefrom to define an annular discharge opening; and said second fluid conducting means comprises a fluid conductor of reduced diameter penetrating the wall of said first fluid conducting means and having a discharge opening substantially coaxially disposed therewithin.

5. The combination according to claim 4 in which said conical body is adjustably mounted within said conically divergent wall portion of said first fluid conducting means.

6. The combination according to any one of the preceding claims in which said inert gas is steam.

* * * * *